US007531793B2

(12) United States Patent
Satoh et al.

(10) Patent No.: US 7,531,793 B2
(45) Date of Patent: May 12, 2009

(54) TANDEM MASS SPECTROMETRY SYSTEM

(75) Inventors: Takaya Satoh, Tokyo (JP); Hisayuki Tsuno, Tokyo (JP)

(73) Assignee: Jeol Ltd., Tokyo (JP)

( * ) Notice: Subject to any disclaimer, the term of this patent is extended or adjusted under 35 U.S.C. 154(b) by 269 days.

(21) Appl. No.: 11/787,029

(22) Filed: Apr. 13, 2007

(65) Prior Publication Data

US 2008/0067351 A1 Mar. 20, 2008

(30) Foreign Application Priority Data

Apr. 14, 2006 (JP) ..... 2006-111530

(51) Int. Cl.
*H01J 49/06* (2006.01)

(52) U.S. Cl. ..... 250/281; 250/282; 250/288

(58) Field of Classification Search ..... 250/281–300
See application file for complete search history.

(56) References Cited

U.S. PATENT DOCUMENTS 6,953,928 B2 * 10/2005 Vestal et al. ..... 250/287

* cited by examiner

*Primary Examiner*—David A Vanore
*Assistant Examiner*—Michael Maskell
(74) *Attorney, Agent, or Firm*—The Webb Law Firm

(57) ABSTRACT

A tandem mass spectrometry system has a first mass spectrometer for creating and extracting precursor ions. The ions are introduced into a decelerating electric field at a slight angle to the direction of the electric field which is formed by first through third electrodes. An accelerating electric field perpendicular to the decelerating electric field is applied at the instant when the ions arrive at the midpoint between the second and third electrodes at which the velocities of the ions in the direction of the decelerating field are zero.

11 Claims, 6 Drawing Sheets

TANDEM MASS SPECTROMETRY SYSTEM

BACKGROUND OF THE INVENTION

1. Field of the Invention

The present invention relates to a tandem mass spectrometry system having a first mass spectrometer for separating and extracting certain precursor ions from an ionized sample and a second mass spectrometer for analyzing plural product ions created by fragmentation of the precursor ions.

2. Description of Related Art

In recent years, tandem mass spectrometry systems for obtaining structural information about precursor ions by selecting the certain precursor ions from an ionized sample, fragmenting the precursor ions, and analyzing created product ions have been used for structural analysis of samples.

In such a tandem mass spectrometry system, precursor ions separated and extracted by the first mass spectrometer are made to fragment into product ions spontaneously or forcedly by a fragmentation device. The product ions are introduced into the second mass spectrometer. The kinetic energy $U_p$ of the product ions introduced into the second mass spectrometer is found from the relational formula:

$$U_p=U_i*(m_p/m_i)$$

where $U_i$ is the kinetic energy possessed by the precursor ions, $m_i$ is the mass of the precursor ions, and $m_p$ is the mass of the product ions. Since the mass $m_p$ of the product ions is smaller than the mass $m_i$ of the precursor ions from which the product ions are produced, i.e., $m_p<m_i$, the kinetic energy $U_p$ of the product ions has an energy range given by $0<U_p<U_i$. Correspondingly, the kinetic energy of the product ions introduced into the second mass spectrometer has a similar range of energy distribution.

On the other hand, with respect to the second mass spectrometer, the energy range of the measurable kinetic energy of the product ions is intrinsic to the instrument and thus is restricted. Therefore, it is necessary to adjust the energy range of the kinetic energies of the introduced product ions to a measurable range. One conventional method of this adjustment consists of decelerating and accelerating the precursor ions exiting from the first mass spectrometer to narrow the range of the kinetic energies of the product ions produced by fragmentation. Furthermore, the product ions introduced into the second mass spectrometer can be mass analyzed with higher accuracy with reducing the kinetic energy range and spatial spread. Consequently, the precursor ions from which the product ions are produced are preferably reduced in kinetic energy range and spatial spread. The kinetic energy range assumed when the precursor ions are introduced into the fragmentation device is set to about 10 to 100 eV in cases where the kinetic energies are several to tens of keV.

With the above-described conventional technique, when the precursor ions are decelerated, there are difficulties in narrowing the kinetic energy range and spatial spread of the precursor ions. In particular, the precursor ions having kinetic energies of several to tens of keV show a range of kinetic energies of about 50 to 100 eV in the initial state. When the precursor ions are decelerated to reduce the kinetic energies, if the deceleration is achieved, for example, by an electric field in the same direction as the direction of motion, the kinetic energy distribution is maintained and the kinetic energies are about 50 to 100 eV. If the deceleration is achieved by an electric field orthogonal to the direction of motion, the spatial spread of the precursor ions remains unchanged (see, for example, JP 2000-505589, page 1, FIG. 1). If the deceleration is achieved by an electric field applied at an angle to the direction of deceleration, the spatial spread of the precursor ions is enlarged.

In consequence, it is important to realize a tandem mass spectrometry system in which precursor ions are decelerated while suppressing both the kinetic energy range and spatial spread of the precursor ions.

SUMMARY OF THE INVENTION

The present invention has been made to solve the foregoing problems with the prior art technique. It is an object of the present invention to provide a tandem mass spectrometry system in which precursor ions are decelerated while narrowing the kinetic energy range and spatial spread of the precursor ions.

A tandem mass spectrometry system built according to a first embodiment of the present invention and solving the above-described object comprises: a first mass spectrometer for ionizing a sample to create ionized precursor ions and for separating and extracting the ionized precursor ions; deceleration means for decelerating the extracted precursor ions which have been separated and extracted by the first mass spectrometer; and a second mass spectrometer for mass analyzing the product ions that are constituent materials of the precursor ions. The deceleration means has a decelerating electrode arrangement and a variable power supply. The decelerating electrode arrangement produces a decelerating electric field in a direction of deceleration intersecting the direction of motion of the exiting precursor ions at a small angle. The variable power supply varies the voltage applied to the decelerating electrode arrangement. The decelerating electrode arrangement has first, second, third, and fourth electrodes. The first, second, and third electrodes are arranged from a position close to the exit port of the first mass spectrometer in an opposite relationship to each other in the direction of deceleration, the precursor ions being exited from the exit port. The fourth electrode is spaced in a direction perpendicular to the direction of deceleration from the midpoint between the second and third electrodes in the direction perpendicular to the direction of deceleration. In the midpoint, the velocity components of the precursor ions in the direction of deceleration are null. When the precursor ions arrive at the midpoint, the second and third electrodes are placed at the same potential by the variable power supply. Where the precursor ions are positively charged, the fourth electrode is placed at a lower potential than the second and third electrodes by the variable power supply. Where the precursor ions are negatively charged, the fourth electrode is placed at a higher potential than the second and third electrodes by the variable power supply.

In the first embodiment, the second and third electrodes are placed at the same potential by the variable power supply when the precursor ions arrive at the midpoint between the second and third electrodes at which the velocity components of the precursor ions in the direction of deceleration become null. Where the precursor ions are positively charged, the fourth electrode is placed at a lower potential than the second and third electrodes. Where the precursor ions are negatively charged, the fourth electrode is placed at a higher potential than the second and third electrodes.

A second embodiment of the present invention is based on the first embodiment and further characterized in that the second and third electrodes of the tandem mass spectrometry system are axisymmetric in the direction of deceleration with respect to an axis (symmetric axis) in the perpendicular direction passing through the midpoint.

In the second embodiment, an axisymmetric electric field is produced between the second and third electrodes, and the precursor ions are focused along the symmetric axis.

A third embodiment of the present invention is based on the first or second embodiment and further characterized in that the first mass spectrometer of the tandem mass spectrometry system is a magnetic mass spectrometer or time-of-flight mass spectrometer.

In the third embodiment, the precursor ions emerging from the first mass spectrometer have kinetic energies ranging from about 10 to 100 eV.

A fourth embodiment of the present invention is based on any one of the first through third embodiments and further characterized in that the tandem mass spectrometry system is equipped with an ion guide between the deceleration means and the second mass spectrometer.

In the fourth embodiment, the efficiency at which the precursor ions are transported is enhanced by the ion guide.

A fifth embodiment of the present invention is based on any one of the first through fourth embodiments and further characterized in that the second mass spectrometer of the tandem mass spectrometry system is an ion-trap mass spectrometer or Fourier transform ion cyclotron mass spectrometer.

In the fifth embodiment, the second mass spectrometer has a mechanism for fragmenting the precursor ions.

A sixth embodiment of the present invention is based on the fifth embodiment and further characterized in that the second mass spectrometer is an ion-trap mass spectrometer and that the tandem mass spectrometer has a third mass spectrometer for mass analyzing product ions which have been trapped and fragmented by the ion-trap mass spectrometer.

In the sixth embodiment, the product ions produced by the second mass spectrometer are mass analyzed by the third mass spectrometer separate from the second mass spectrometer.

A seventh embodiment of the present invention is based on the fifth embodiment and further characterized in that the second mass spectrometer which is a Fourier transform ion cyclotron mass spectrometer uses ECD (electron capture dissociation) or IRPMD (infrared multiphoton dissociation) in creating product ions by fragmenting the precursor ions.

An eighth embodiment of the present invention is based on the first embodiment and further characterized in that the tandem mass spectrometry system has a fragmentation device for fragmenting the precursor ions.

In the eighth embodiment, a mass spectrometer not equipped with a fragmentation mechanism is used as the second mass spectrometer.

A ninth embodiment of the present invention is based on any one of the fifth, sixth, and eighth embodiments and further characterized in that the ion-trap mass spectrometer or the fragmentation device uses CID to fragment the precursor ions by collision with gas.

According to the present invention, the kinetic energy range and spatial distribution of precursor ions emitted from the first mass spectrometer are narrowed. Spectral resolution and mass accuracy obtained when product ions arising from the precursor ions are mass analyzed by the second mass spectrometer can be prevented from deteriorating.

Other objects and features of the invention will appear in the course of the description thereof, which follows.

DESCRIPTION OF THE PREFERRED EMBODIMENTS

The best mode for implementing a tandem mass spectrometry system according to the present invention is hereinafter described with reference to the accompanying drawings. Note that the invention is not limited thereby.

Figure 1:
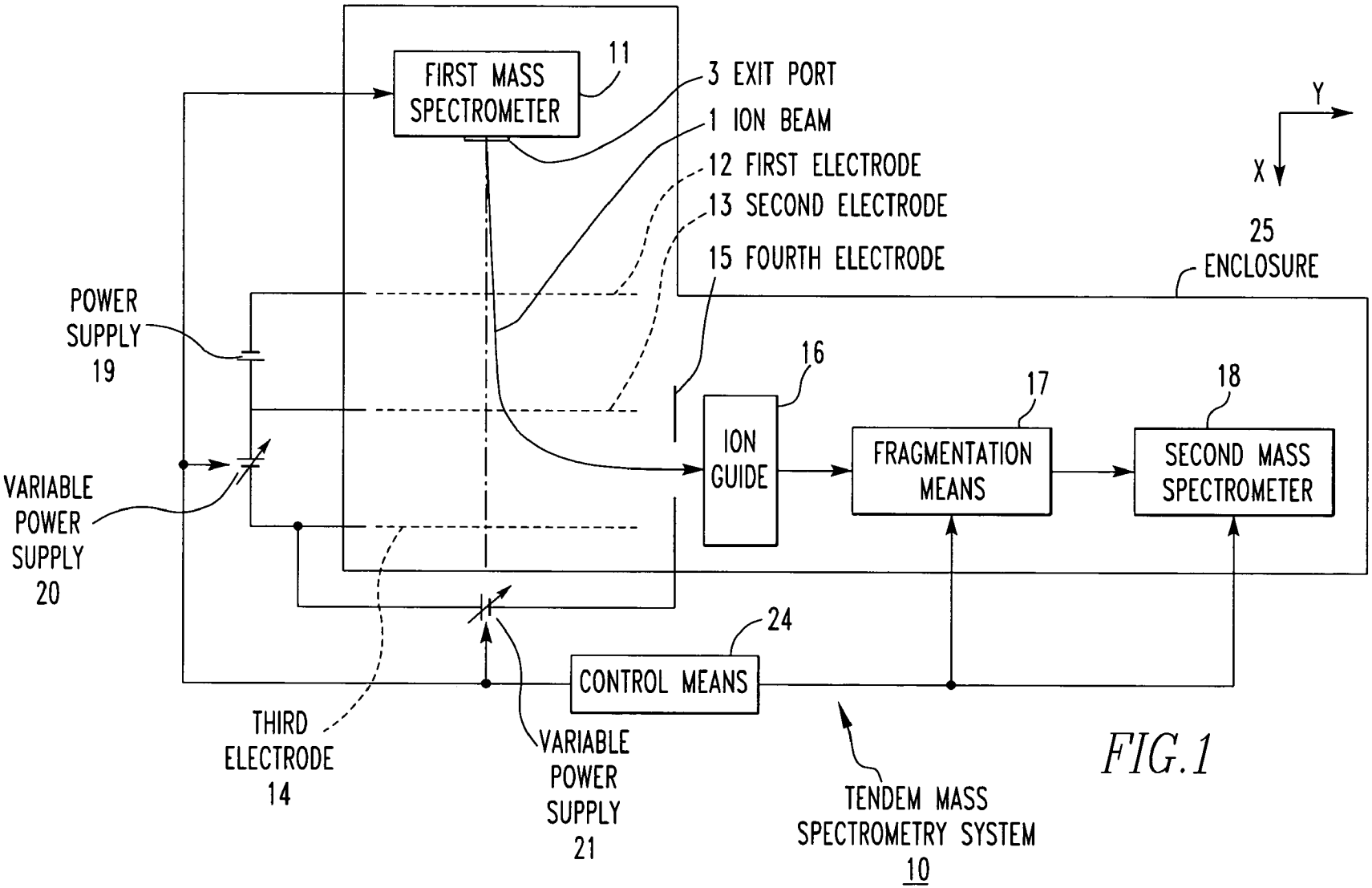
FIG. 1 is a block diagram showing the whole structure of a tandem mass spectrometry system according to an embodiment of the present invention.

Referring to FIG. 1, a tandem mass spectrometry system according to an embodiment of the present invention is shown. The whole system is generally indicated by reference numeral 10. The tandem mass spectrometry system 10 includes a first mass spectrometer 11, a first electrode 12, a second electrode 13, a third electrode 14, a fourth electrode 15, an ion guide 16, fragmentation device 17, a second mass spectrometer 18, an enclosure 25, a power supply portion 19, a variable power supply 20, and another variable power supply 21. In the figure, the x and y coordinates indicate coordinate axis directions common to all the figures.

The enclosure 25 is a vacuum vessel that houses the first mass spectrometer 11, first electrode 12, second electrode 13, third electrode 14, fourth electrode 15, ion guide 16, fragmentation device 17, and second mass spectrometer 18. The inside of the vacuum vessel is evacuated to a high degree of vacuum by evacuation means (not shown).

For example, a magnetic mass spectrometer is used as the first mass spectrometer 11. A time-of-flight mass spectrometer (TOFMS) can also be used as the first mass spectrometer 11. With the magnetic mass spectrometer, the sample is ionized in the ion source. The resulting precursor ions are accelerated with a constant acceleration voltage Va. At this time, the velocity v acquired by the precursor ions is given by $$v = \sqrt{\frac{2Z\,e\,Va}{M}} \tag{1}$$

where Z is the valence of the precursor ions, M is the mass, and e is the elementary electric charge.

Then, the precursor ions having velocity v are introduced into a space having a uniform magnetic flux density B from a direction perpendicular to the magnetic flux density B. At this time, the precursor ions make a rotary motion with a radius $r_m$ inversely proportional to the velocity v. The relationship between the radius $r_m$ and the velocity v is given by $$\frac{M\,v^2}{r_m} = Z\,e\,v\,B \tag{2}$$

From the above equation, the mass-to-charge ratio M/Z of the precursor ions is given by $$M/Z = \frac{e\, r_m^2 B^2}{2\, Va} \quad (3)$$

If the first mass spectrometer 11 is so designed that it extracts only precursor ions flying with radius $r_m$, the first mass spectrometer 11 makes a scan in which the magnitude of the magnetic flux density B is varied. The spectrometer 11 acquires precursor ions having different M/Z in succession to obtain a mass spectrum. When certain precursor ions are separated and extracted, the magnitude of the magnetic flux density B is kept fixed. The certain precursor ions are ejected from the exit port 3 of the first mass spectrometer 11. The precursor ions acquire kinetic energies of several to tens of keV from the flight. The kinetic energies range from about 10 to 100 eV.

The first electrode 12, second electrode 13, third electrode 14, fourth electrode 15, power supply portion 19, and variable power supply portions 20, 21 together form means for decelerating the precursor ions. The decelerating means decelerates the ion beam 1 exiting from the first mass spectrometer 11.

The first through third electrodes 12-14 consist, for example, of meshy planar conductor patterns disposed parallel to each other. The ion beam 1 emitted from the first mass spectrometer 11 is transmitted through the meshy planar conductor patterns. Cross sections of the meshy planar conductor patterns are indicated by the dotted lines in FIG. 1.

The power supply portion 19 and the variable power supply portion 20 are connected with the first through third electrodes 12-14 to produce an electric field for decelerating the precursor ions in the direction of deceleration that is coincident with the x-axis direction. In FIG. 1, there are shown the power supply portion 19 and variable power supply portion 20 which produce voltages applied to the first through third electrodes 12-14 in a case where the ion beam 1 is positively charged. Where the ion beam 1 is negatively charged, the polarities of the voltages applied to the electrodes 12-14 from the power supply portions 19 and 20 are reversed to those shown in FIG. 1.

A decelerating electric field for decelerating positive ions having velocity v is produced between the first electrode 12 and the second electrode 13 in the direction of deceleration coincident with the x-axis direction. Also, a decelerating electric field for decelerating positive ions is produced between the second electrode 13 and the third electrode 14 in the direction of deceleration coincident with the x-axis direction. The voltage applied between the first electrode 12 and the second electrode 13 is about 10 kV. The voltage applied between the second electrode 13 and the third electrode 14 is on the order of hundreds of volts.

The direction of departure of the ion beam 1 exiting from the first mass spectrometer 11 is tilted at a slight angle of about 2°, for example, to the x-axis direction coincident with the direction of the electric field produced among the first electrode 12 through third electrode 14. As a result, the kinetic energies possessed by the precursor ions in the x-axis direction range approximately from 10 to 100 eV, while the kinetic energies in the y-axis direction are in a narrow range from about 1 to 10 eV.

The power-supply output voltage from the variable power supply portion 20 is variable from about 0 V to hundreds of volts.

The fourth electrode 15 is made, for example, of an annular electrode plate centrally provided with a hole permitting passage of precursor ions. The fourth electrode 15 is spaced a given distance from the second electrode 13 and third electrode 14 in the y-axis direction. The position of the hole in the electrode plate in the x-axis direction is set equal to the midpoint between the second electrode 13 and third electrode 14 in the x-axis direction. The variable power supply portion 21 is connected between the fourth electrode 15 and third electrode 14. An accelerating electric field for accelerating the precursor ions in the y-axis direction is produced between the fourth electrode 15 and third electrode 14. Where the ions are positive ions, the voltage applied from the third electrode 14 toward the fourth electrode 15 is about minus tens of volts. Where the ions are negative ions, the voltage is about plus hundreds of volts.

The ion guide 16 is used to introduce the precursor ions, which have been passed through the fourth electrode 15, into the fragmentation device 17 without diffusing them. As an example, the ion guide has an internal electrode plate to produce an electric field that guides the precursor ions to the fragmentation device 17.

The fragmentation device 17 fragments the introduced precursor ions into product ions constituting the precursor ions. The fragmentation can be performed using CID (collision induced dissociation) in which the precursor ions are collided against gaseous matter to fragment the ions or a method in which the precursor ions are illuminated with light to fragment the ions.

The second mass spectrometer 18 performs a mass analysis of the product ions created by the fragmentation device 17. The second mass spectrometer 18 may be a magnetic mass spectrometer similarly to the first mass spectrometer 11. Alternatively, a quadrupole mass analyzer (QMS), ion-trap mass spectrometer (ITMS), TOF mass spectrometer (TOFMS), Fourier transform ion cyclotron resonance mass spectrometer (FT-ICRMS), or other instrument may be used as the second mass spectrometer. The tandem mass spectrometry system 10 acquires structural information about unfragmented precursor ions based on mass information about the product ions obtained by the second mass spectrometer 18.

The tandem mass spectrometry system 10 further includes controller 24 which has an arithmetic portion and a storage portion and controls various components including the first mass spectrometer 11, variable power supply portion 20, fragmentation device 17, and second mass spectrometer 18 to fragment the precursor ions emitted from the first mass spectrometer 11 in such a way that their kinetic energy range and spatial spread are narrowed.

Figure 2:
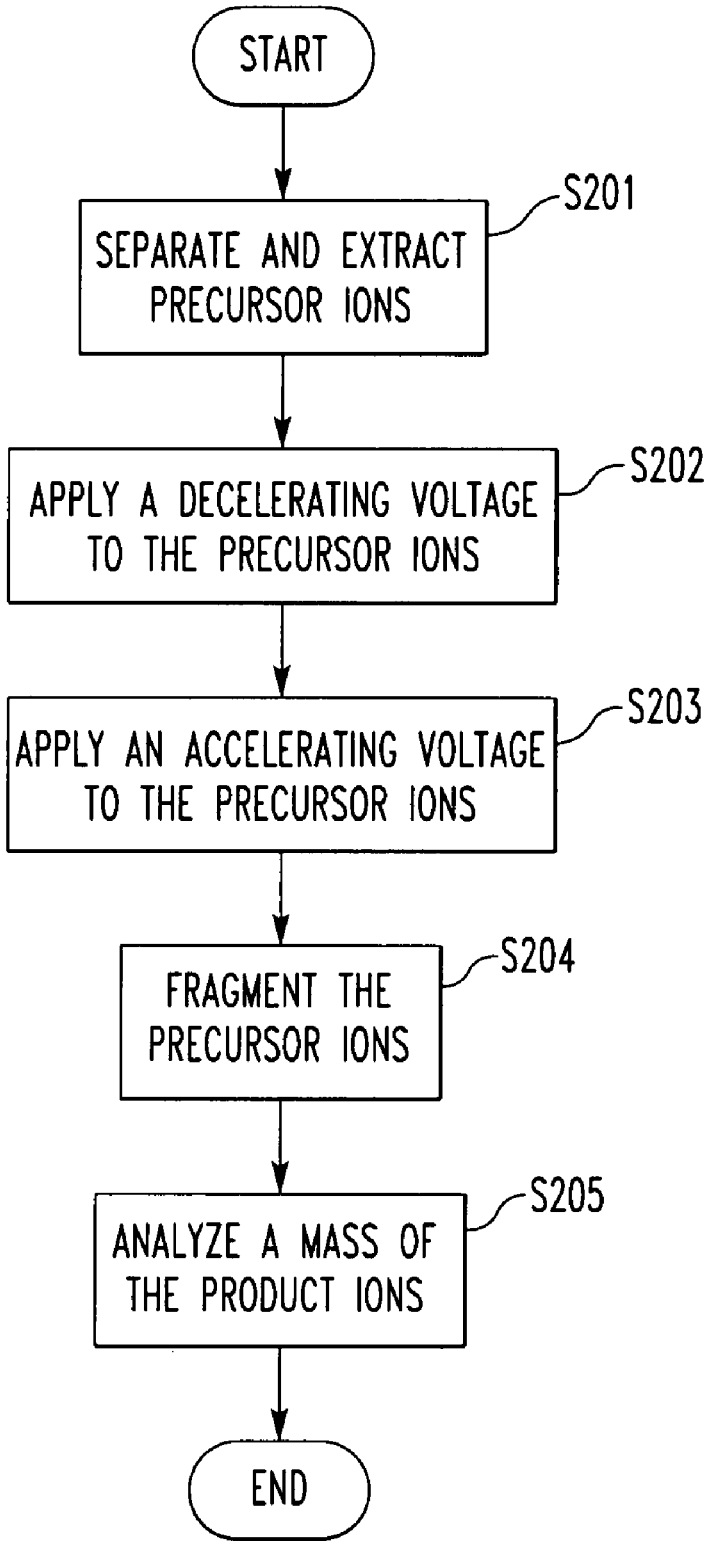
FIG. 2 is a flowchart illustrating a sequence of operations of a tandem mass spectrometry system according to an embodiment of the present invention.

The operation of the controller 24 is next described by referring to the flowchart of FIG. 2. First, the controller 24 instructs the first mass spectrometer 11 to separate and extract precursor ions to be fragmented (step S201). The precursor ions are separated and extracted, for example, by a magnetic mass spectrometer from a sample that has been ionized by the ion source of the first mass spectrometer 11. As described previously, the precursor ions which have been separated and extracted are ejected from the exit port 3 in an oblique direction making a slight angle to the x-axis direction in which the decelerating electric field is produced.

Figure 3A:
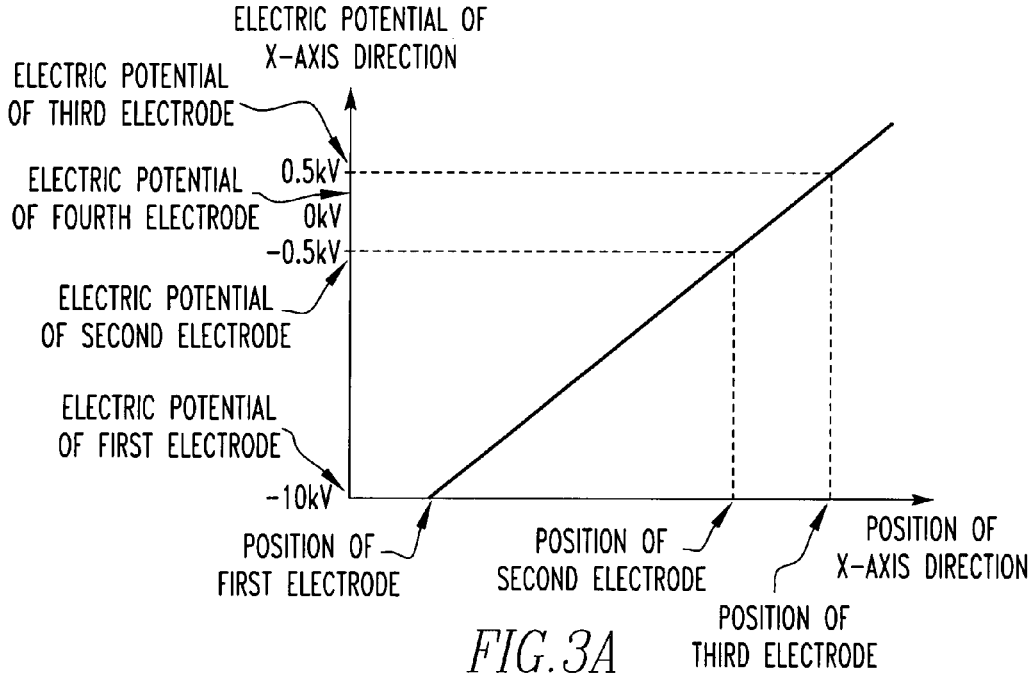
FIGS. 3A and 3B show graphs representing the potential distribution between electrodes of a tandem mass spectrometry system according to an embodiment of the present invention.

Then, the controller 24 applies a decelerating voltage to the precursor ions to decelerate the velocity components of the ions in the x-axis direction (step S202). One example of this decelerating voltage is shown in FIG. 3A. The potentials at the first electrode 12, second electrode 13, third electrode 14, and fourth electrode 15 are set to −10 kV, −0.5 kV, 0.5 kV, and 0 kV, respectively. The potential between the first electrode 12 and second electrode 13 is applied from the power supply portion 19. The potential between the second electrode 13 and third electrode 14 is applied from the variable power supply portion 20. The potential between the third electrode 14 and fourth electrode 15 is applied from the variable power supply portion 21.

The first electrode 12, second electrode 13, and third electrode 14 are arranged in turn in the x-axis direction. The space between the first and second electrodes is 95 cm. The space between the second and third electrodes is 5 cm. The potential created by these electrodes in the x-axis direction varies linearly as shown in FIG. 3A. The decelerating electric field that is a potential gradient faces in the negative direction of the x-axis and has a constant magnitude. The fourth electrode 15 is spaced in the y-axis direction perpendicular to the x-axis from the midpoint between the second electrode 13 and third electrode 14 in the x-axis direction. The potential at the fourth electrode 15 is set to the same potential, 0 V, as the midpoint between the second electrode 13 and third electrode 14. Therefore, the potential distribution in the x-axis direction is not affected by the presence of the fourth electrode 15.

The distances and potentials between the first through third electrodes 12-14 are so set that the velocity components of the precursor ions in the direction of deceleration in the midpoint between the second electrode 13 and third electrode 14 in the x-axis direction are set to null. The velocity components of the precursor ions in the direction of deceleration are distributed as described previously. Therefore, the velocity component of the precursor ions having the average velocity of the range of velocity components is set to 0.

Returning to FIG. 2, the controller 24 applies an accelerating voltage to the precursor ions to accelerate them in the y-axis direction at the instant when the precursor ions emitted from the first mass spectrometer 11 reach the midpoint between the second electrode 13 and third electrode 14 (step S203). As described previously, the velocity components in the x-axis direction are reduced down to zero when the precursor ions reach the midpoint between the second electrode 13 and third electrode 14. For this purpose, the switching timing is determined taking account of various factors such as the outgoing velocity from the first mass spectrometer 11, the angle of tilt from the x-axis, the magnitude of the decelerating electric field, and the distance of the first mass spectrometer 11 to the midpoint between the second electrode 13 and the third electrode 14.

Figure 3B:
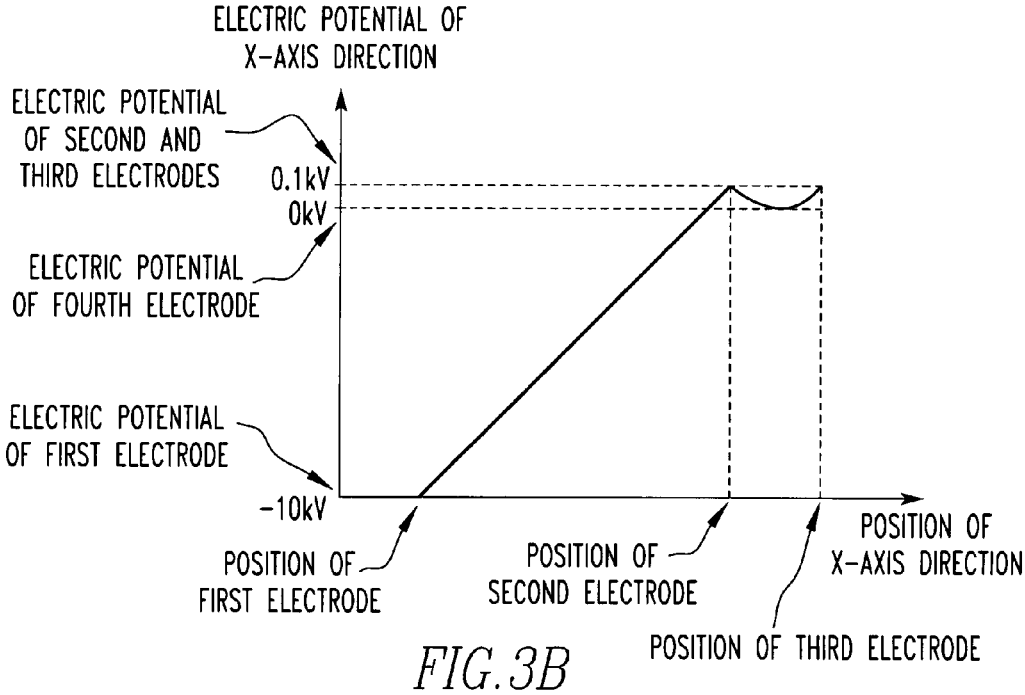

FIG. 3(B) shows one example of the accelerating voltage. The potentials at the first electrode 12, second electrode 13, third electrode 14, and fourth electrode 15 are set to −10 kV, 0.1 kV, 0.1 kV, and 0 kV, respectively. The second electrode 13 and third electrode 14 are placed at the same potential by setting the output from the variable power supply portion 20 to 0 V. The potential difference between the third electrode 14 (or the second electrode 13 at the same potential as the third electrode) and the fourth electrode 15 is set to 0.1 kV by the variable power supply portion 21.

Figure 4:
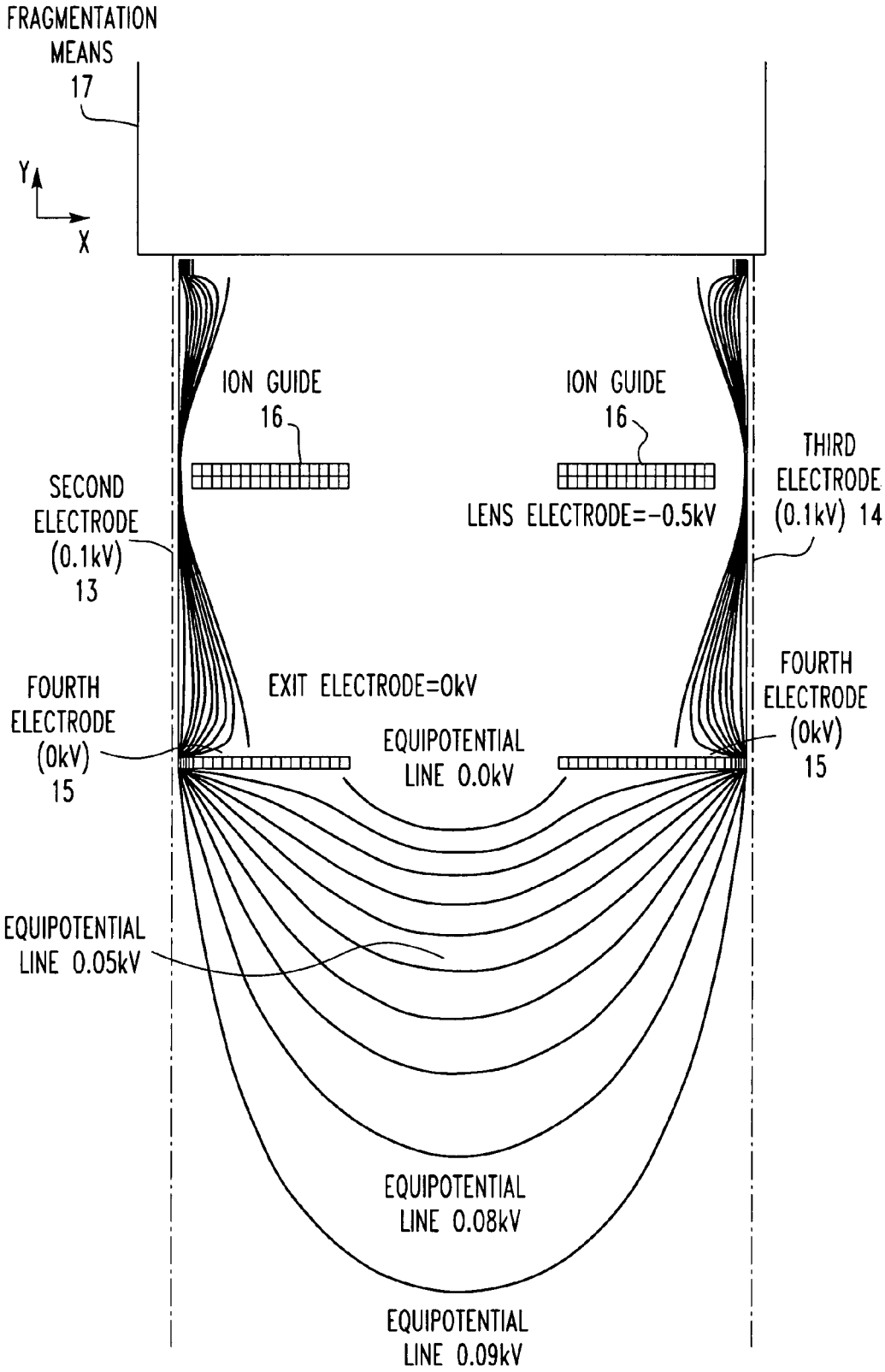
FIG. 4 is a graph particularly showing the potential distribution between the second and third electrodes.

Consequently, the potential distribution between the second electrode 13 and the third electrode 14 assumes a cone-shaped form whose both ends are kept at the same potential; the intermediate positions are at low potentials. FIG. 4 shows the potential distribution at the xy cross section through the midpoint between the second electrode 13 and third electrode 14. A lens electrode forming the ion guide 16 and fragmentation device 17 are also shown in FIG. 4. The shown potential distribution also includes the lens electrode, which is placed at a potential, for example, of −0.5 kV.

The potential distribution is axisymmetric about the midpoint between the second electrode 13 and the third electrode 14 in the x-axis direction. The equipotential lines of the potential distribution are indicated by solid lines at intervals of 0.01 kV in FIG. 4. The electric field defined as the gradient of the equipotential lines faces in the y-axis direction at the midpoint between the second electrode 13 and third electrode 14. However, the electric field is tilted toward the midpoint in peripheral regions located from the midpoint to the second electrode 13 or third electrode 14. Therefore, positively charged precursor ions which undergo a force directed toward the midpoint and which are located in peripheral regions off the midpoint are thus focused. The potential distribution has a gradient directed in the positive y-axis direction as a whole. Positively charged precursor ions are accelerated and passed into the fragmentation device 17.

Figure 5A:
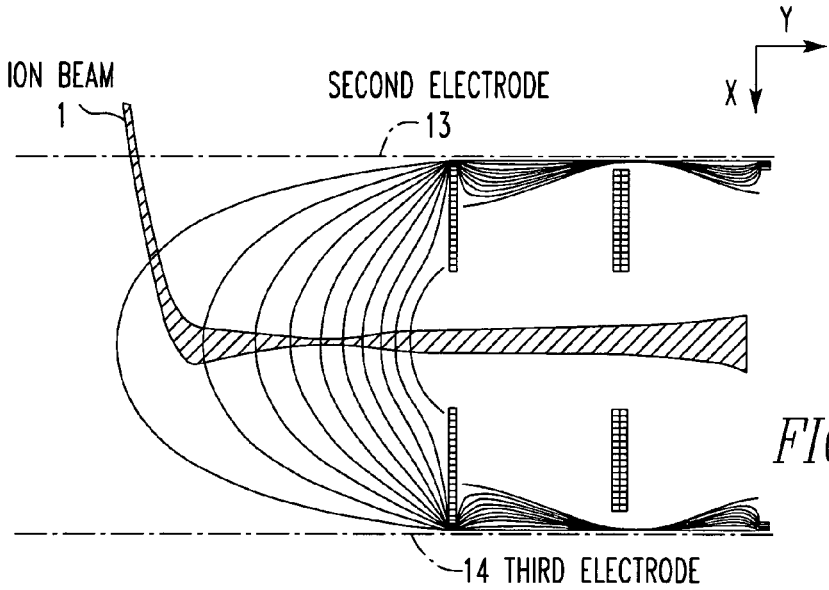
FIGS. 5A to 5C show diagrams of trajectories of ion beams incident between the second and third electrodes.
Figure 5B:
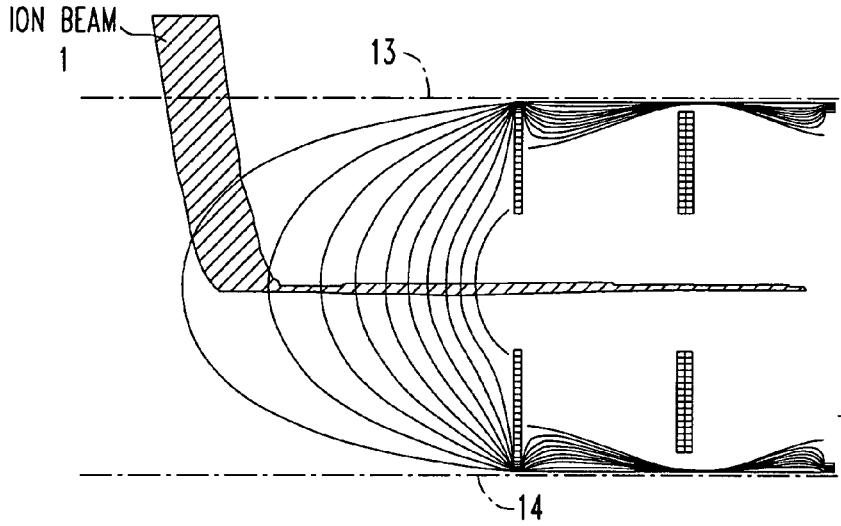

FIGS. 5A and 5B show the trajectories of the ion beam 1 which arrives at the fragmentation device 17 after the beam 1 enters the space between the second electrode 13 and third electrode 14, the space being in a potential distribution as shown in FIG. 4. Results of simulations of the trajectory of the ion beam 1 are shown for cases where the kinetic energy assumed when the beam enters, the position, and incident angle have ranges of values.

FIG. 5A shows the trajectory of the ion beam 1 when its kinetic energy has a range of values of 10,012±50 eV. In this case, the ion beam 1 includes precursor ions having different velocities and so when the beam is bent from the x-axis direction to the y-axis direction by applying an accelerating electric field, the position assumed in the x-axis direction differs according to each different precursor ion. Consequently, the beam spreads. Where the precursor ions deviate from the midpoint between the second electrode 13 and third electrode 14 in the x-axis direction, a force directed toward the midpoint acts on the precursor ions. Therefore, the spread of the precursor ions is suppressed and, at the same time, the ions are accelerated in the y-axis direction.

FIG. 5B shows a trajectory of the ion beam 1 in a case where the beam enters under the condition where the position of the beam 1 has a range of values, ±0.5 mm, in the y-axis direction. That is, the beam enters while spreading. In this case, the beam 1 is bent to the y-axis direction at the same position in the x-axis direction and so the bent beam 1 has reduced spread and thus has been focused highly.

Figure 5C:
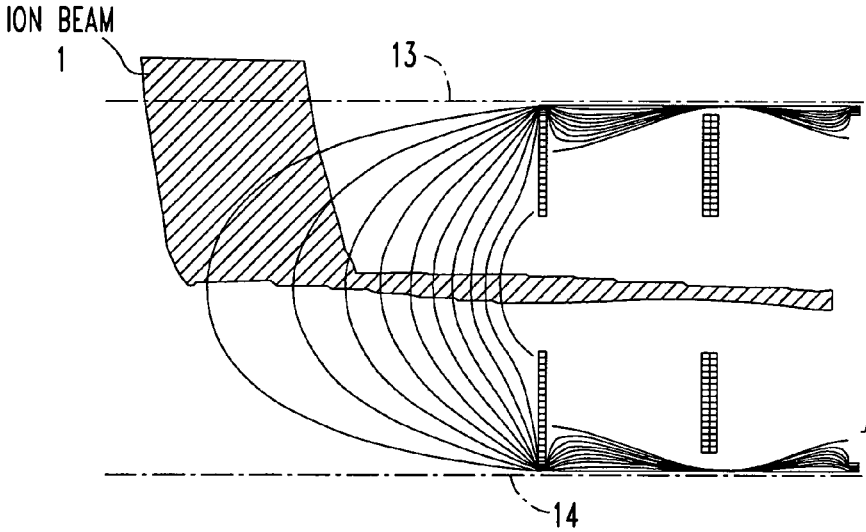

FIG. 5C shows a trajectory of the ion beam 1 in a case where the incident angle of the beam 1 has a range of values, 2°±0.3°. In this case, when the ion beam 1 is bent to the y-axis direction from the x-axis direction by application of an acceleration electric field, the positions assumed in the x- and y-axis directions, respectively, are different among each different precursor ion. However, the spread of the precursor ions in the x-axis direction is reduced by a force which acts on the ions and is directed toward the midpoint.

Where the ion beam 1 shows ranges of kinetic energies, positions, and angles when the beam enters as in the above-described simulations, the kinetic energy has a range given by 90±10 eV when the beam arrives at the fragmentation device 17. The beam spread in the x-axis direction is about 1 mm.

Positive ions have a wide range of energies in the x-axis direction. This wide range gives rise to a variation in the direction of movement when the beam is moved in the y-axis direction. On the other hand, the variation is reduced by a focusing accelerating voltage and, therefore, the range of energies in the x-axis direction can be narrowed. As a result, a narrow range of energies in the y-axis direction prevails. At this time, the kinetic energies of precursor ions have a range of about tens of keV.

Consequently, if the timing at which the voltage is switched from a decelerating voltage to an accelerating voltage deviates, for example, the precursor ions are focused toward the midpoint. The precursor ions can be guided into a hole located in the center of the fourth electrode 15. Also, the magnitude of the kinetic energy of the precursor ions entered into the fragmentation device 17 can be adjusted by the presence of the accelerating voltage. The magnitude can be optimized for the fragmentation device 17 or for the second mass spectrometer 18.

Returning to FIG. 2, the precursor ions accelerated in the y-axis direction are introduced into the fragmentation device 17 to fragment the ions under the control of the controller 24 (step S204). Plural product ions constituting precursor ions are created as independent ions.

Then, the product ions created in step S204 are mass analyzed by the second mass spectrometer 18 under control of the controller 24 (step S205). The present processing is ended. As described previously, the range of kinetic energies of the precursor ions is suppressed to ±10 eV. The beam width in the x-axis direction is suppressed to about 1 mm. Accordingly, the range of the kinetic energies of the product ions created from the precursor ions is suppressed to about ±10 eV as described above in connection with the related art. In consequence, the second mass spectrometer 18 performs a mass analysis without deteriorating the resolution of the product ion spectrum or mass accuracy.

As described so far, in the present embodiment, precursor ions created and extracted by the first mass spectrometer 11 are made to obliquely enter the decelerating electric field produced by the first electrode 12, second electrode 13, and third electrode 14 at a slight angle to the direction of the decelerating electric field. The accelerating electric field perpendicular to the decelerating electric field is applied at the timing when the precursor ions arrive at the midpoint between the second electrode 13 and the third electrode 14 at which the velocity of the ions in the direction of the decelerating electric field is zero. The ions are introduced into the fragmentation device 17. Consequently, the range of the kinetic energies of the precursor ions is narrowed. This can narrow the range of the kinetic energies of the product ions produced from the precursor ions by the fragmentation device 17. When the product ions are mass analyzed in the second mass spectrometer 18, deterioration of spectral resolution and mass accuracy is prevented.

Furthermore, in the present embodiment, the precursor ions are fragmented into product ions by the fragmentation device 17. The fragmentation may also be performed by the second mass spectrometer. In this case, an ion-trap mass spectrometer (ITMS) or Fourier transform ion cyclotron resonance mass spectrometer (FTICRMS) is used as the second mass spectrometer.

Figure 6:
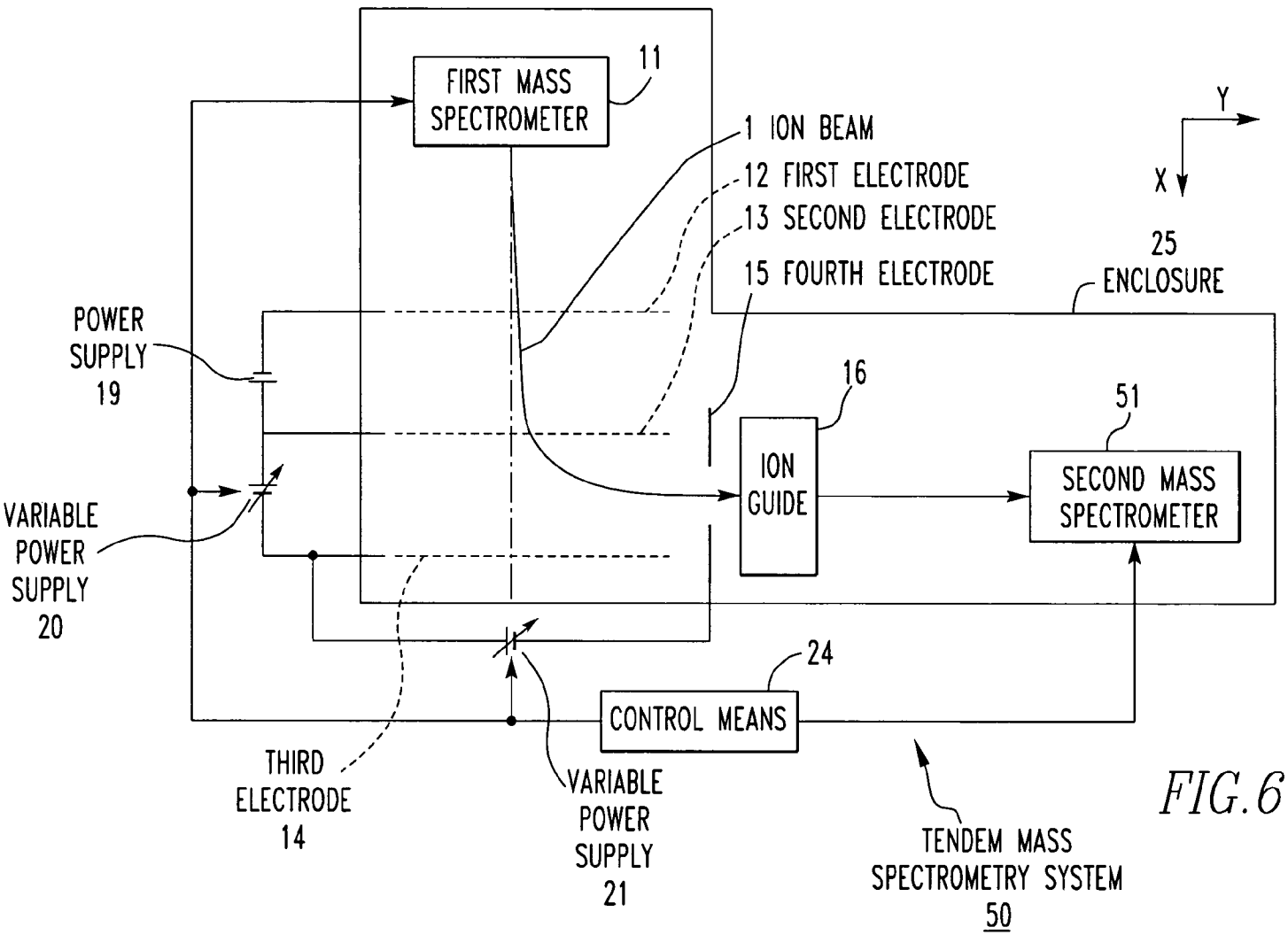
FIG. 6 is a block diagram showing the whole structure of a tandem mass spectrometry system having no fragmentation device.

FIG. 6 is a diagram showing the whole configuration of a tandem mass spectrometry system designed based on this concept. The spectrometry system is generally indicated by reference numeral 50. This spectrometry system 50 is similar to the tandem mass spectrometry system 10 already described in connection with FIG. 1 except that the fragmentation device 17 and second mass spectrometer 18 of the tandem mass spectrometry system 10 shown in FIG. 1 have been replaced by a second mass spectrometer 51 made of an ITMS or FTICRMS. Where the second mass spectrometer 51 is made of an ITMS, product ions fragmented by the built-in ion trap can be mass analyzed using a third mass spectrometer (not shown) connected to a later stage.

A quadrupole mass spectrometer can introduce precursor ions efficiently similarly to an ion-trap mass spectrometer and a Fourier transform ion cyclotron resonance mass spectrometer. Therefore, the quadrupole mass spectrometer suppresses the kinetic energies of the precursor ions to tens of keV. The diameter of the entrance hole for the precursor ions is set to a small value on the order of millimeters. Therefore, where precursor ions are introduced into these mass spectrometers using deceleration means including the first through fourth electrodes 12-15 together with any one of these mass spectrometers, the range of the kinetic energies and spatial spread of the precursor ions is narrowed. Consequently, mass analysis is enabled without deterioration of spectral resolution and mass accuracy.

Where a Fourier transform ion cyclotron resonance mass spectrometer is used as the second mass spectrometer, ECD (electron capture dissociation) or IRPMD (infrared multiphoton dissociation) can also be used as a method of fragmenting precursor ions.

Having thus described our invention with the detail and particularity required by the Patent Laws, what is desired protected by Letters Patent is set forth in the following claims.

The invention claimed is:

1. A tandem mass spectrometry system comprising:

a first mass spectrometer for ionizing a sample to create ionized precursor ions and for separating and extracting the ionized precursor ions;

deceleration means for decelerating the precursor ions which have been separated and extracted by the first mass spectrometer; and a second mass spectrometer for mass analyzing the product ions that are constituent materials of the precursor ions;

said deceleration means having a decelerating electrode arrangement and a variable power supply for varying a voltage applied to the decelerating electrode arrangement that produces a decelerating electric field in a direction of deceleration intersecting at a small angle with a direction of motion of the precursor ions ejected from the first mass spectrometer;

said decelerating electrode arrangement having first, second, and third electrodes arranged in an opposite relationship to each other in the direction of deceleration from a position close to an exit port of the first mass spectrometer from which the precursor ions are ejected;

said decelerating electrode arrangement further including a fourth electrode spaced in a direction perpendicular to the direction of deceleration from a midpoint between the second and third electrodes in the direction of deceleration;

said midpoint being set to a position where velocity components of the precursor ions in the direction of deceleration are null; and said variable power supply acting (i) to place the second and third electrodes at the same potential when the precursor ions arrive at the midpoint, (ii) to place the fourth electrode at a lower potential than the second and third electrodes in a case where the precursor ions are positively charged, and (iii) to place the fourth electrode at a higher potential than the second and third electrodes in a case where the precursor ions are negatively charged.

2. A tandem mass spectrometry system as set forth in claim 1, wherein said second and third electrodes are axisymmetric in said direction of deceleration about an axis in said perpendicular direction passing through said midpoint.

3. A tandem mass spectrometry system as set forth in any one of claims 1 and 2, wherein said first mass spectrometer is a magnetic mass spectrometer or a time-of-flight mass spectrometer.

4. A tandem mass spectrometry system as set forth in any one of claims 1 and 2, wherein there is further provided an ion guide between said deceleration means and said second mass spectrometer.

5. A tandem mass spectrometry system as set forth in any one of claims 1 and 2, wherein said second mass spectrometer is an ion-trap mass spectrometer or a Fourier transform ion cyclotron mass spectrometer.

6. A tandem mass spectrometry system as set forth in claim 5, wherein said second mass spectrometer is the ion-trap mass spectrometer, and wherein there is further provided a third mass spectrometer for mass analyzing product ions which are captured and fragmented by the ion-trap mass spectrometer.

7. A tandem mass spectrometry system as set forth in claim 5, wherein said second mass spectrometer is the Fourier transform ion cyclotron mass spectrometer, and wherein the Fourier transform ion cyclotron mass spectrometer fragments the precursor ions into product ions by ECD or IRPMD.

8. A tandem mass spectrometry system as set forth in claim 1, wherein there is further provided fragmentation means for fragmenting said precursor ions.

9. A tandem mass spectrometry system as set forth in claim 5, wherein (A) said second mass spectrometer is the ion-trap mass spectrometer, (B) there is further provided fragmentation means for fragmenting said precursor ions, and (C) said ion-trap mass spectrometer or said fragmentation means uses CID to fragment the precursor ions by collision with gas.

10. A tandem mass spectrometry system as set forth in claim 6, wherein (A) said second mass spectrometer is the ion-trap mass spectrometer, (B) there is further provided fragmentation means for fragmenting said precursor ions, and (C) said ion-trap mass spectrometer or said fragmentation means uses CID to fragment the precursor ions by collision with gas.

11. A tandem mass spectrometry system as set forth in claim 8, wherein (A) said second mass spectrometer is the ion-trap mass spectrometer, (B) there is further provided fragmentation means for fragmenting said precursor ions, and (C) said ion-trap mass spectrometer or said fragmentation means uses CID to fragment the precursor ions by collision with gas.

* * * * *